US006044879A

United States Patent [19]

Ray

[11] Patent Number: 6,044,879

[45] Date of Patent: Apr. 4, 2000

[54] LAMINATED CARDBOARD PURSE AND METHOD OF MAKING THE SAME

[76] Inventor: Frances E. Ray, 4911 Trail Lake, Houston, Tex. 77045

[21] Appl. No.: 08/534,348

[22] Filed: Sep. 25, 1995

[51] Int. Cl.[7] ..... A45C 13/26

[52] U.S. Cl. ..... 150/107; 150/119; 150/129

[58] Field of Search ..... 190/107, 115, 190/118, 119, 125; 150/107, 108, 119, 129; 229/31, 141, 148, 198.3, 199, 125.11, 909, 87.18, 87.19

[56] References Cited

U.S. PATENT DOCUMENTS

| | | | |
|---|---|---|---|
| 1,701,954 | 2/1929 | Lowe | 190/119 X |
| 2,320,166 | 5/1943 | Arnold | 190/119 |
| 2,761,609 | 9/1956 | Arkin | 229/198.1 X |
| 2,788,933 | 4/1957 | Kessler | 229/198.1 X |
| 2,822,013 | 2/1958 | Renz | 190/119 X |
| 3,335,775 | 8/1967 | Adams | 150/119 X |
| 3,346,155 | 10/1967 | Oechsle | 150/108 X |
| 3,972,467 | 8/1976 | Whillock et al. | 229/3.1 X |
| 4,374,555 | 2/1983 | March | 190/126 X |
| 4,919,240 | 4/1990 | Tobias | 150/108 X |

*Primary Examiner*—Jes F. Pascua
*Attorney, Agent, or Firm*—Kenneth D. Baugh

[57] ABSTRACT

A purse 10 is provided with a front wall 14 and a back wall 16 aligned with and spaced from the front wall. The purse 10 is also provided with a first side wall 18 which is aligned to engage one end of the front and back walls 14 and 16 and a second side wall 20 which is aligned to engage another end of the front and back walls. A bottom wall 22 is aligned to engage bottom portions of the front and back walls 14 and 16 and first and second side walls 18 and 20. Additionally a lid 36 is provided having portions thereof aligned adjacent to the back wall 16. A decorative member 58 is provided which is coupled to an outside wall of the front, back, and side walls 14, 16, 18 and 20 and the lid 36. The purse is provided with lamination 60 for engaging inside and outside portions of the walls. The lid 36 is pivotably coupled to the back wall so that the lid can be moved to cover an opening 24 in the purse. Further a latch 48 is provided to couple the lid 36 to the front wall. A handle 62 is provided to allow a user to carry the purse.

5 Claims, 3 Drawing Sheets

LAMINATED CARDBOARD PURSE AND METHOD OF MAKING THE SAME

TECHNICAL FIELD

This invention relates to purses and more particularly to a Laminated Cardboard purse and method of making same. For as long as we can remember purses have served as a storage container for carrying all sorts of women's necessities and other accessories. The popularity and practicality of purses is well known. As a result you now have purses that can be used for just about every occasion. However more and more there is a need for a purse that can be readily used in the everyday work environment as well as a leisurely environment. The purse for the work and the leisurely environment should be sturdy and durable while also fashionable. Some persons satisfy this need with a single purse for the numerous occasions. Others would prefer having a different purse for the different occasions and environments they may encounter. However, this practice of individual purses for the different environments and occasions can be expensive.

Accordingly, a purse is needed that is fashionable, while still durable and inexpensive enough to make it practical for a user to own as many purses as may be desired for use in the user's work as well as leisure environment.

BACKGROUND OF THE ART

Attempts have been made to provide purses that are desirable which can also satisfy the various needs of a user. One such purse is disclosed in U.S. Pat. No. 3,964,529. This purse is a kit for assembling a purse which employs an outside covering chosen by the purchaser. The kit includes a personal stiffening member in which the outside member is folded, an inner liner which is adhesively applied to the perimeter of the folded edges and the appropriate hardware such as fasteners and footrests. This purse attempts to satisfy the various needs of a user in an inexpensive way by providing a do it yourself kit. For those who do not readily adopt to fabricating their own purses this is not a desirable alternative. Another arrangement is disclosed in U.S. Pat. No. 4,649,974. The handbag of this invention is one that has a replaceable laminated decorative cover. In this handbag a decorative cover is provided which is replacably attached to a purse frame. Accordingly, this purse can be used for various occasions and be coordinated with the clothes of the user by replacing the decorative cover. This purse also requires some self fabrication on the part of the user.

These arrangements are suitable for users that desire a single purse that may be converted to fit more than one occasion.

However there is still a need for an inexpensive but durable purse that will allow a user to own as many purses as desired to accommodate the different environments and occasions for which a purse may be desired.

DISCLOSURE OF THE INVENTION

A purse in accordance with the principles of this invention is provided with a front planar member and a back planar member aligned with and spaced from the front planar member. The purse is also provided with a first side planar member which is aligned to engage one end of the front and back planar members and a second side planar member which is aligned to engage another end of the front and back planar members. A bottom planar member is aligned to engage bottom portions of the front and back and first and second side planar members. Additionally a top planar member is provided having end portions thereof aligned adjacent to the back planar member. A decorative member is provided which engages an outside wall of the front, back, side and top planar members. An adhesive member for coupling the decorative members to the outside walls of the front, back, side and top planar members is also provided.

The purse is further provided with a lamination member for engaging inside and outside walls of the planar members. An adhesive member is provided to couple the lamination members to the planar members. A first coupling means is provided to couple the front, back, side and bottom planar members together to form an enclosure having an opening formed therein.

A second coupling means pivotably couples those portions of the top planar member that are aligned adjacent to the back planar member to the back planar member so that the top planar member can be moved to cover the opening. Further a third coupling means is provided to couple the top planar member to the front planar member so that the top planar member can be held in a position covering the opening. A handle is also coupled to the top planar member so that a user can carry the purse when desired.

A method of making a laminated cardboard purse out of a cardboard sheet in accordance with the principles of this invention includes a first step of applying an adhesive to one side of the cardboard sheet. A sheet of decorative paper is then mounted to that side of the cardboard sheet having the adhesive applied thereto. Once this is done a predetermined force is applied to the decorative sheet so that the decorative sheet is coupled to the cardboard sheet by the adhesive. Both sides of the cardboard sheet are then laminated. Once this is done the laminated cardboard sheet is cut into a predetermined number of pieces of predetermined sizes and configurations so that an enclosure having an opening formed therebetween can be formed and so that a top to cover the opening can be formed. The laminated cardboard pieces are then coupled together to form the enclosure having the top. A latching means is then coupled to the enclosure to allow the top to be secured in place over the opening and a handle is mounted to the top of the enclosure.

BRIEF DESCRIPTION OF THE INVENTION

The details of the invention will be described in connection with the accompanying drawing in which.

BEST MODE FOR CARRYING OUT THE INVENTION

Figure 1:
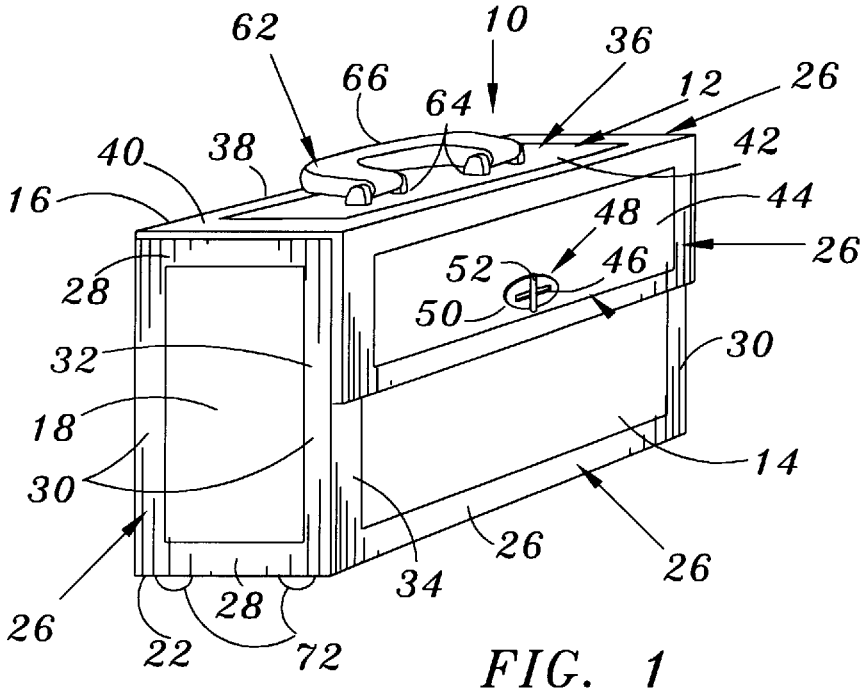
FIG. 1 is a perspective view illustrating a laminated cardboard purse in accordance with the principles of this invention.
Figure 2:
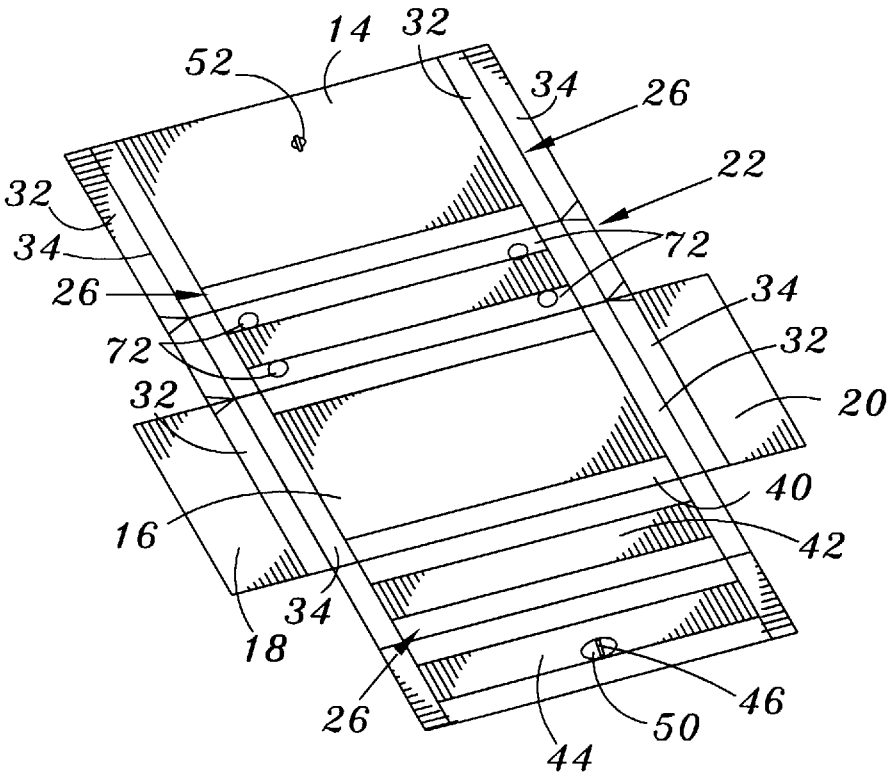
FIG. 2 is a second expanded perspective view illustrating a laminated cardboard purse in accordance with the principles of the invention.
Figure 3:
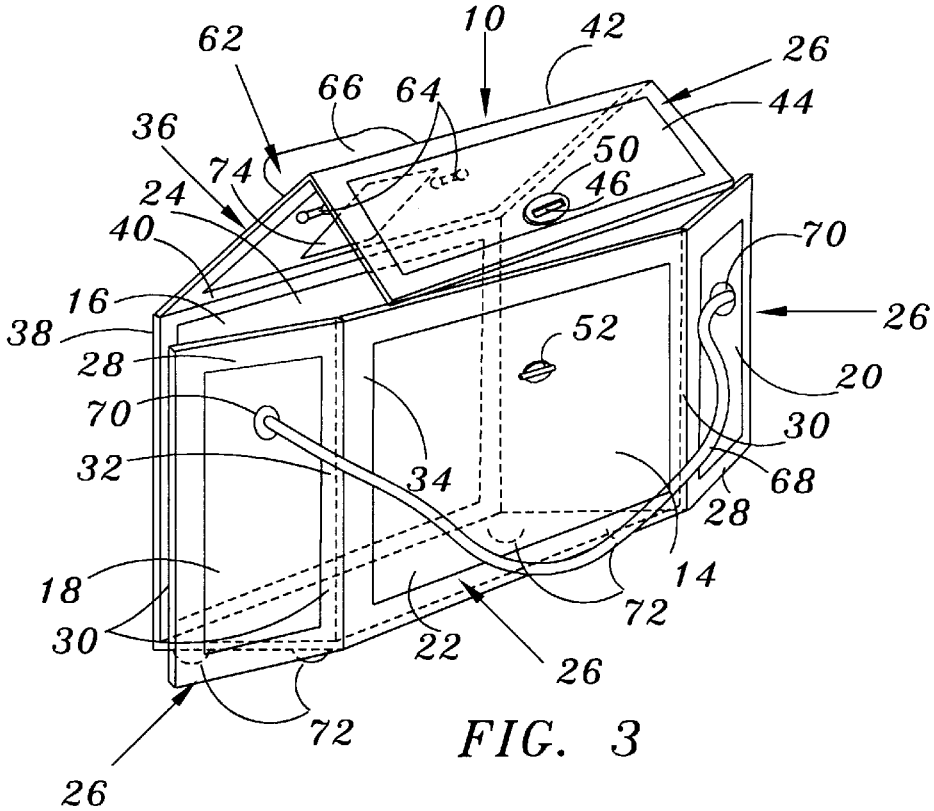
FIG. 3 is a third perspective view illustrating a laminated cardboard purse in accordance with the principles of this invention.

Referring to FIGS. 1, 2 and 3 a laminated cardboard purse, generally designated by the numeral, 10, is illustrated. The laminated cardboard purse 10 includes an enclosure, generally designated, by the numeral, 12. The enclosure 12 is provided with front and back walls, 14 and 16, side walls, 18 and 20 and a bottom wall, 22. The walls 14, 16, 18, 20 and 22 are coupled together to form the enclosure 12 having an open area 24 (FIG. 3) formed therebetween.

The walls 14, 16, 18, 20 and 22 are coupled together using coupling members, generally, designated by the numeral, 26. The coupling members 26 are aligned to engage inside and outside portions of the walls 14, 16, 18, 20 and 22. The coupling members 26 can be, for example, book tape or hinging tape. The coupling members 26 are provided with horizontally extending members 28 and vertically extending members 30. The horizontally extending members 28 and the vertically extending members 30 of the coupling members 26 each have two intersecting portions 32 and 34 which engage aligned intersecting walls of the enclosure 12, where necessary, to securely couple the walls of the enclosure.

The enclosure 12 is also provided with a lid or top, generally designated by the numeral, 36. The lid 36 is pivotably coupled to an upper end portion 38 of the back wall 16 of the enclosure 12 by coupling member 40 aligned to engage inside and outside portions of the lid and back wall. The coupling member 40 may also be book tape or hinging tape. The lid 36 is provided with a first member 42 and a second member 44, having and opening 46 formed therein. A latch 48, having a support member 50 formed on the lid 36 and an engaging member 52 mounted for pivotable movement on the front wall 14 of the enclosure 12, is provided to fasten the lid to the front wall and secure any contents inside the enclosure. The lid members 42 and 44 of the lid 36 are coupled together by coupling members 26 just as are walls 14, 16, 18, 20 and 22.

Figure 4:
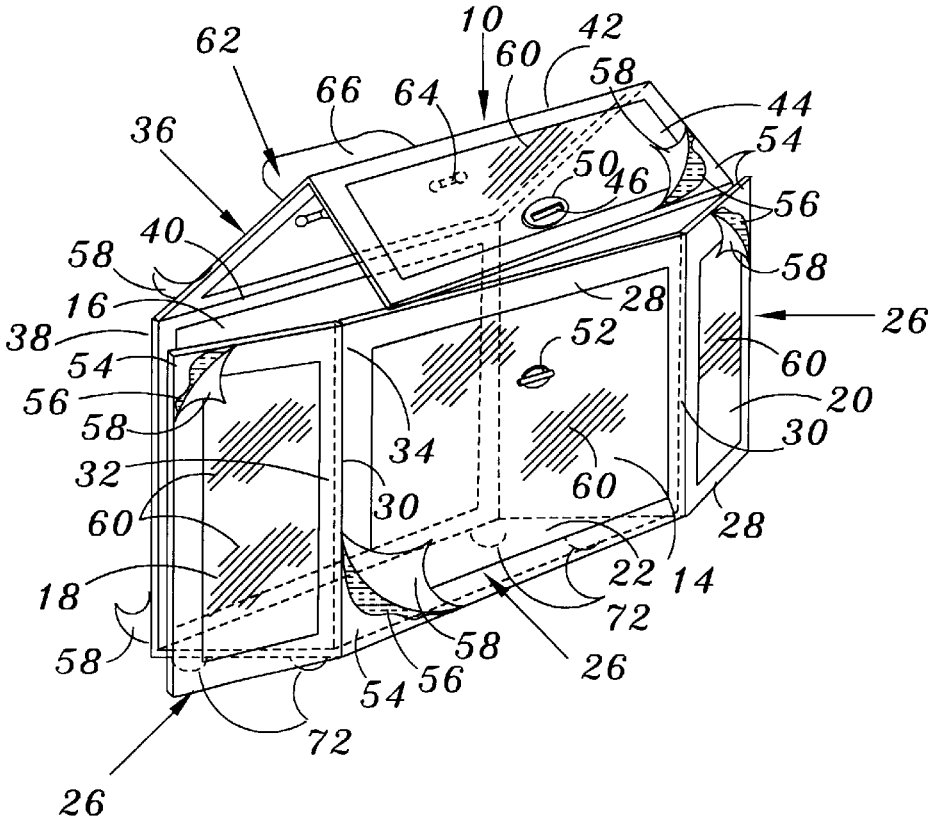
FIG. 4 is a fourth perspective view illustrating a laminated cardboard purse in accordance with the principles of this invention.
Figure 5:
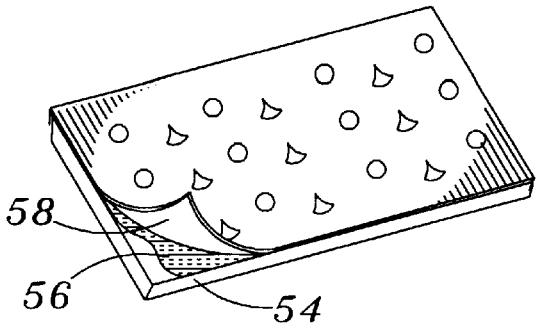
FIG. 5 is a perspective view of a cardboard member used for making the laminated cardboard purse in accordance with the principles of this invention.
Figure 6:
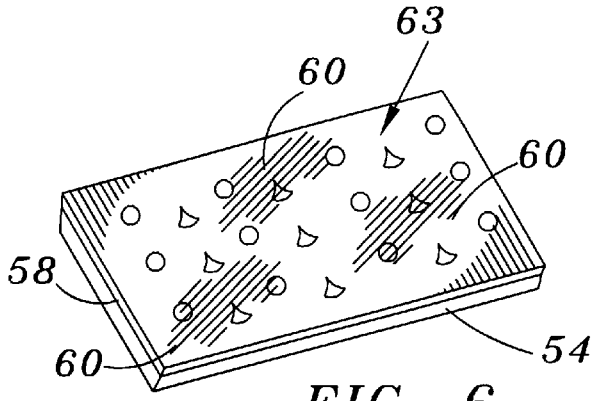
FIG. 6 is a perspective view of a laminated cardboard member used for making the laminated cardboard purse in accordance with the principles of this invention.

Referring to FIGS. 4, 5 and 6 the walls 14, 16, 18, 20 and 22 and the lid 36 are formed of a planar member 54 made of cardboard. An adhesive layer, 56 is provided adjacent the planar member 54. A decorative member 58, such as, for example, a decorative paper is provided and coupled to the planar member 54 by the adhesive member 56. The walls 14, 16, 18, 20 and 22 and lid 36 are also provided with a layer of lamination 60 formed on the inside and outside portions of the walls and lid.

The enclosure 12 of the purse 10 is also provided with a handle, generally designated by the numeral, 62 which is coupled to the lid 36 of the enclosure (FIG. 1). The handle 62 is provided with support members 64 coupled to the lid 36 of the enclosure 12 and a grip member 66 pivotably coupled to the support members.

A shoulder strap, generally designated by the numeral, 68 can be mounted adjacent the side walls 18 and 20 of the enclosure 12 (FIG. 3). The strap 68 is coupled to the side walls 18 and 20 of the enclosure 12 by coupling members 70.

The handle 62 is provided to allow a user to pick up and carry the purse 10 by hand when desired and the strap 68 can be used to allow the user to carry the purse 10 by hand or by placing the strap across the users' shoulder when desired.

The laminated cardboard purse 10 is also provided with raised support members 72 formed in the bottom wall 22 of the enclosure for supporting the purse in a raised position when the purse is placed on a supporting structure.

The purse 10 can also be provided with a mirror 74 (FIG. 3) which may be mounted on an inside portion of the member 42 of the lid 36.

As illustrated in FIG. 5 and 6, when making a laminated cardboard purse 10 in accordance with the principles of this invention the process begins with the cardboard sheet 54. The adhesive 56 is applied to one side of the card board sheet 54. The sheet of decorative paper 58 is then mounted to the side of the cardboard sheet 54 which has the adhesive 56 applied thereto. Once this is done a predetermined force is applied to the decorative sheet 58 so that the decorative sheet is securely coupled to the cardboard 54 by the adhesive 56. Both sides of the cardboard sheet 54 are then laminated with the layer of lamination 60.

In the alternative only the side of the cardboard sheet 54 having the decorative sheet 58 applied thereto may be laminated with the layer of lamination 60. When using this alternative the other side of the cardboard sheet 54 may be covered with a protective plastic like cover such as for example contact paper.

Figure 7:
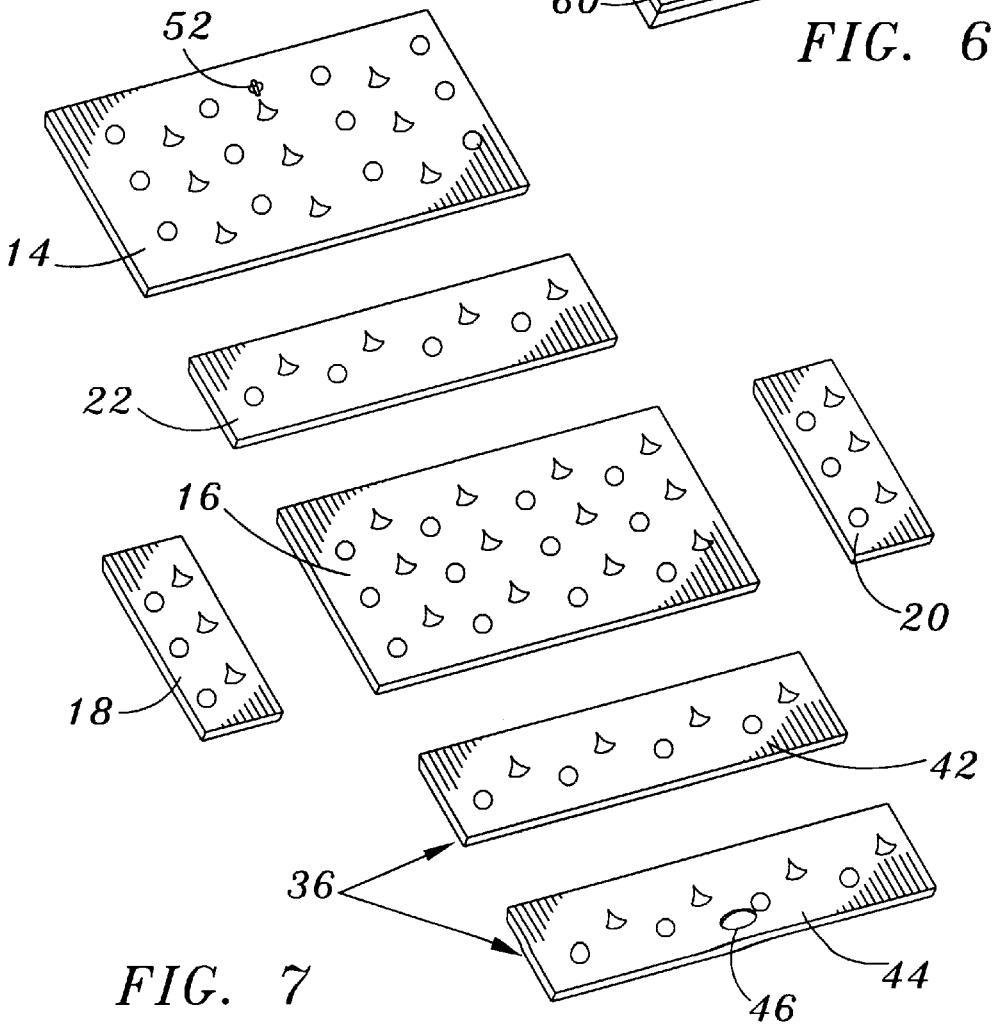
FIG. 7 is an expanded perspective view of the individual members of the laminated cardboard purse in accordance with the principles of the invention.

Once lamination occurs a laminated cardboard sheet generally designated by the numeral 63 (FIG. 6) is formed. The laminated cardboard sheet 63 is then cut into predetermined pieces of predetermined sizes and configurations so that the enclosure 12 having the opening 14 formed therein can be formed and so that a lid for covering the opening can be formed. That is, as illustrated in FIG. 7 the laminated sheet 63 is then cut into seven pieces to form the front and back walls 14 and 16, of the enclosure 12, side walls 18 and 20 of the enclosure, bottom wall 22 of the enclosure and the lid 36 of the enclosure. The lid 36 is formed having the first member 42 and the second member 44 which has the opening 46 formed therein. The laminated cardboard pieces or walls 14, 16, 18, 20, 22 and lid 36 are then coupled together with coupling members 26 to form the enclosure 12 having the open area 24 and the lid 36 (FIG. 1). Once this is accomplished the latch 48 is coupled to the front wall 14 of the enclosure 12 for alignment with the opening 46 in the lid 36 to allow the lid to be securable in place over the opening 24.

Alternatively the latch 48 may also be coupled to the lid 36 and front wall 14 before the walls 14, 16, 18, 20, 22 and lid 36 are coupled together.

The handle 62 can then be mounted to the lid 36 and the raised support members 72 can be coupled to the bottom wall 22 of the enclosure 12. Once this is done the strap 68 can be attached to the side walls 18 and 20 using coupling members 70 and the mirror 74 may be provided if desired. The strap 68 may also be attached to the side walls 18 and 20 before the enclosure 12 is formed. The cardboard purse 10 in accordance with the principles of this invention is then completed.

It should be understood that various changes and modifications can be made without departing from the spirit and scope of the invention as defined in the claims.

What is claimed:

1. A purse including:

a front planar member;

a back planar member aligned with and spaced from the front planar member;

a first side planar member aligned to engage one end of the front and back planar members;

a second side planar member aligned to engage another end of the front and back planar members;

a bottom planar member aligned to engage bottom portions of the front and back and first and second side planar members;

a top planar member having portions aligned adjacent to the back planar member, wherein each planar member is formed of cardboard, and the top planar member includes, a first planar member having first, second and third portions, the first portion being pivotably coupled to the uppermost portions of the back planar member so that the second portion thereof will cover the opening, and a second planar member having first and second portions, the first portion having an opening formed therein and the second portion of the second planar member being pivotably coupled to the third portion of the first planar member so that the first portion of the second planar member is aligned adjacent to the front planar member when the opening is covered;

a decorative member for engaging an outside wall of each one of the front, back, side and top planar members the decorative member including a predetermined pictorial decorative representation on each one of the front, back, side and top planar members;

an adhesive member for coupling the decorative member to the outside wall of each one of the front, back, side and top planar members;

a lamination member for engaging each one of the planar members;

an adhesive member for coupling the lamination members to the planar members;

a first plurality of elongated adhesive members for coupling the front, back, side and bottom planar members together to form an enclosure having an opening formed therein;

a second plurality of elongated adhesive members for pivotably coupling portions of the top planar member which are aligned adjacent to the back planar member so that the top planar member can be selectively moved to cover the opening, the first plurality of elongated adhesive members and the second plurality of elongated adhesive members including a predetermined number of horizontally and vertically extending strips of hinging tape;

a first coupling means for coupling the top planar member to the front planar member so that the top planar member can be held in a position covering the opening, and the first coupling means including a latch mounted for pivotable movement on the front planar member to cooperate with the opening in the first portion of the second planar member to lock the top planar member to the front planar member;

a handle coupled to the top planar member; and a mirror coupled to an inside portion the first planar member.

2. A purse as defined in claim 1 including a shoulder strap having one end thereof coupled to the first side planar member and another end thereof couple to the second side planar member.

3. A purse as defined in claim 2 wherein the lamination member includes:

a first lamination member for engaging inside walls of each planar member; and a second lamination member for engaging outside walls of each planar member.

4. A purse as defined in claim 3 wherein the lamination member includes a first member for engaging outside walls of each planar member and wherein a plastic like protective cover is provided to engage the inside walls of each planar member.

5. A purse as defined in claim 4 wherein the thin decorative pulp like member for engaging the outside walls of each one of the front, back side and top planar members is a decorative paper having a predetermined pictorial decorative representation.

* * * * *